United States Patent [19]

Gallinati

[11] 4,177,877

[45] Dec. 11, 1979

[54] SAFETY VEST

[76] Inventor: Albert A. Gallinati, 820 E. McKinley St., Mundelein, Ill. 60060

[21] Appl. No.: 879,783

[22] Filed: Feb. 21, 1978

[51] Int. Cl.[2] ..... A62B 35/00

[52] U.S. Cl. ..... 182/3; 2/96

[58] Field of Search ..... 182/3–9; 244/151 R, 143; 2/93, 94, 96, 101

[56] References Cited

U.S. PATENT DOCUMENTS

| | | | |
|---|---|---|---|
| 2,613,865 | 10/1952 | Rose | 182/3 |
| 2,979,153 | 4/1961 | Hoagland | 182/3 |
| 3,074,074 | 1/1963 | Lovering | 182/3 |
| 3,176,793 | 4/1965 | Hlacia | 182/3 |
| 3,701,395 | 10/1972 | Theobald | 182/3 |
| 3,973,643 | 8/1976 | Hutchinson | 182/3 |
| 4,076,101 | 2/1978 | Himmelrich | 182/3 |

*Primary Examiner*—Reinaldo P. Machado
*Attorney, Agent, or Firm*—John J. Kowalik

[57] ABSTRACT

A vest adapted to be worn by a workman operating at perilous heights. The vest has straps between the lining and the outer fabric. The straps have crossed sections in the back of the garment and vertical sections in the front panels. The lower ends of the front and rear section are secured to a body embracing belt which is sewed to the fabric along the belt line. The upper end of each crossed section extends from one side of the vest to the other and has its upper end formed into a hooking loop with the upper end of the vertical section at that side of the vest, the loop projecting through an opening formed in the associated shoulder portion of the garment for connection to one end of flexible line which is adapted at its other end to be secured to structure at an elevation higher than where the workman is operating.

10 Claims, 5 Drawing Figures

FIG. 1
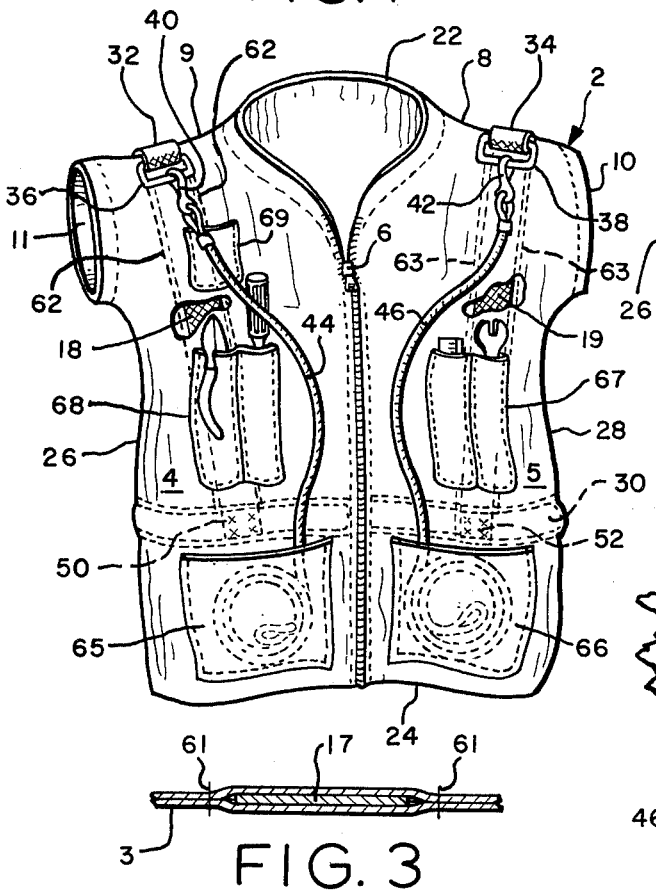
FIG. 3
FIG. 4
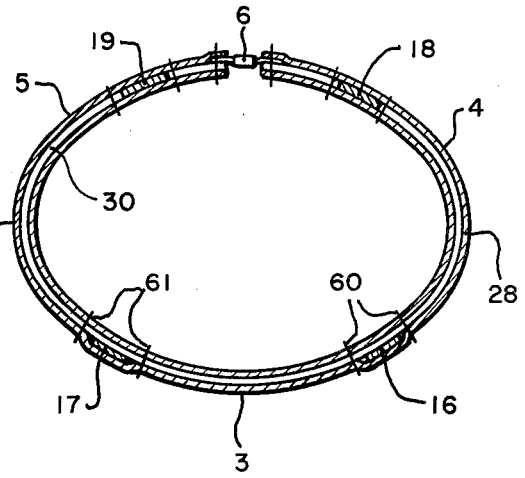
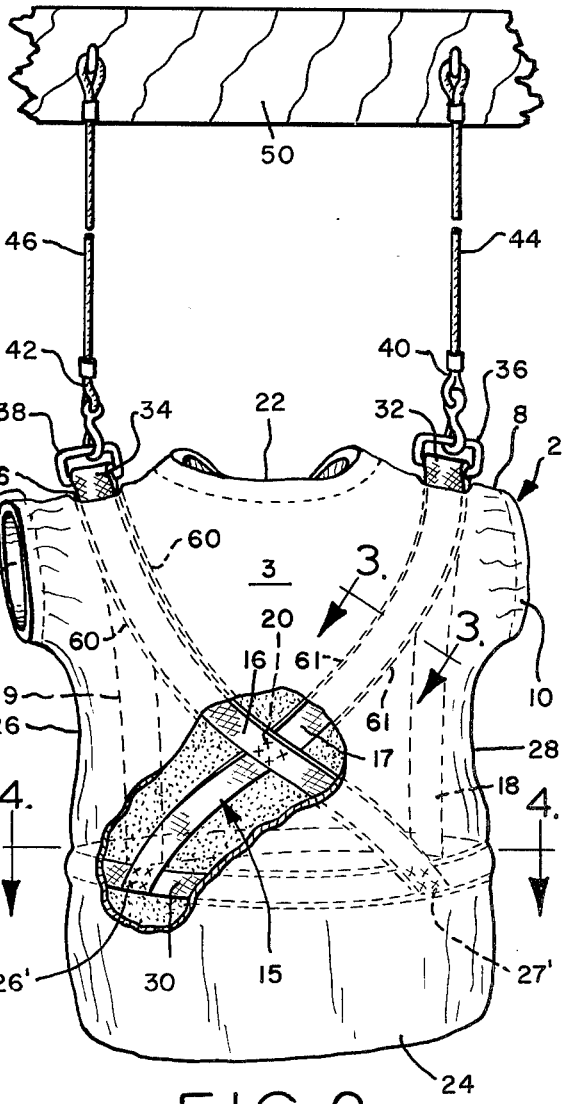
FIG. 2
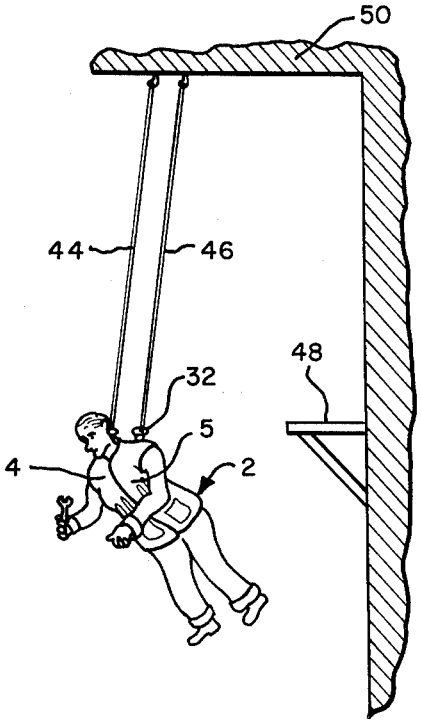
FIG. 5

SAFETY VEST

DISCUSSION OF THE PRIOR ART

The best art found were U.S. Pat. Nos. 2,066,072; 3,886,508; 1,178,397 and 2,162,948. These patents illustrate various garments with ring attachments for connection to securing tethers. They do not provide an arrangement of straps which embrace the user without constraint so that he may work comfortably without hindrance and at the same time optimize the requirements of taking up sudden shock loads which are imposed such as when the user falls off a work perch and is jerked to a sudden stop when he reaches the end of the slack in the tether.

SUMMARY OF THE INVENTION

This invention is directed to a novel garment incorporating a safety harness which is easily integrated with the garment and which distributes the forces in an optimum manner.

Specifically it is an object of the invention to provide a novel safety vest having support straps which have crossed sections in the back and parallel portions in the front at the sides of the front panels of the vest, the straps being preferably, but not necessarily sewn to the fabric of the vest and also to a body-encompassing belt-like waist strap which is sewn to the back and front sections of the vest.

A general object is to provide a novel safety garment comprising a novel arrangement of straps which effectively distribute the sudden tension loads when the securing tether is snapped taut.

These and other objects and advantages of the invention will become more readily apparent from the specification and the drawings, wherein:

FIG. 1 is a front view of the vest incorporating the invention;

FIG. 2 is a rear view with portions broken away and the vest being shown in hung position;

FIG. 3 is an enlarged fragmentary sectional view taken substantially on line 3—3 of FIG. 2;

FIG. 4 is a cross-sectional view taken substantially on line 4—4 of FIG. 2; and

FIG. 5 is a perspective view showing the user in the novel vest in a hung position from overhead structure.

DESCRIPTION OF THE INVENTION

The novel garment generally designated 2 is shown as a vest but it may also be a jacket or other similar outer garment.

The garment has an outer shell fabric which includes the usual back panel 3, front side panels 4 and 5 interconnected by a closure zipper 6. The garment has right and left shoulder portions 8 and 9 and sleeves 10,11 with armholes.

The garment incorporates a strap arrangement generally indicated 15 which includes crossed back sections 16,17 and vertical front sections 18,19. The crossed sections are interconnected intermediate their ends in a juncture connection 20 which is positioned intermediate the neck portion 22 and the lower edge 24 of the vest and medially between the sides 26,28.

The lower ends 26',28' of the rear strap sections are connected to a waist located belt section 30 of the strap which is located below the juncture 20 at approximately the waist of the user.

The junctures of the upper ends of the crossed straps and respective vertical straps are formed as loops 32,34 which are passed through rectangular rings 36,38 to which there are secured hook locks 40,42 which are secured to the lower ends of the tethers or flexible cords or cables 44,46.

The upper ends of these cables are adapted to be secured to an overhead structure such as a beam 50 in any conventional way such as by looping the rope over the rafter and tying the rope thereto or to any hook or the like secured to the beam above the user who may be working on a perch or scaffold 48 and the like.

It will be noted that the lower ends 50,52 of the front strap sections are sewn to the adjacent portions of the circumferential belt section.

The loops 32,34 are extended above the respective shoulder portions through openings 55,56.

The straps are preferably woven fabric such as cotton or synthetic material viz. plastic, nylon, dacron, etc. and preferably the rear and front portions of the straps are not directly sewn to the fabric but are pocketed between the shell and the lining 58 between lines of sewing 60,61,62,63 along opposite edges of the respective strap sections. It is also contemplated that the straps may be made of elastomeric material such as the Du-Pont "Lycra" so as to provide resilient or yieldable load-absorbing extensions of the tethers.

The garment is preferably provided with several tool pockets 65,66,67,68 and 69 for convenient access by the user.

A preferred embodiment of the invention has been disclosed and it will now become apparent that various modifications will come to mind to those skilled in the art which fall within the scope of the appended claims.

I claim:

1. A safety garment having an inner and an outer shell, and a yieldable and slidable strap assembly within the shells including front and rear portions adapted to pass behind the user's back and chest respectively, and a circumferentially extending belt section adapted to extend about the waist of the user, said front and rear portions having lower ends overlapping the belt section, means connecting said lower ends of the strap portions to adjacent portions of the belt section, said front and rear portions having upper ends joined to form loops, tether means connected to the loops, and means foreshortening the effective lengths of said rear portions of the strap assembly and disposed in an area of the garment on the back side thereof intermediate said belt section and the upper portion of the garment and abuttable with each other upon tensioning said belt assembly through said loops.

2. The invention according to claim 1 and said means including said rear portions of the strap assembly being crossed and having a juncture connection intermediate their ends to each other and located at approximately the spine of the user.

3. The invention according to claim 2 and said strap sections being formed of elastomeric material stretchable in tension to stop a fall of the user of the garment.

4. The invention according to claim 3 and said front portions extending vertically at opposite sides of the front of the garment.

5. The invention according to claim 1 and a said foreshortening means including said rear portions of the strap assembly being crossed and the front portions extending vertically and each rear portion extending diagonally from one side of the garment diagonally upwardly to the shoulder at the opposite side of the garment and joining with the front strap portion at that side of the garment in a tether attachment loop extending above the shoulder of the garment at that side thereof.

6. The invention according to claim 5 and said strap portions being sewn to the garment.

7. The invention according to claim 5 and said strap portions being formed of woven elastomeric fabric.

8. The invention according to claim 7 and said belt portion being of stretchable material.

9. The invention according to claim 8 and said garment having a lining, and said strap assembly being held captive between the shell and the lining.

10. The invention according to claim 1 and said garment having shoulder portions and said belt portions having loops extending through openings in the shoulder portions and said garment having front panels and means releasably securing said panels along adjacent edges to each other and said belt terminating at said edges.

* * * * *